US005233852A

United States Patent [19]

Starke

[11] Patent Number: 5,233,852

[45] Date of Patent: Aug. 10, 1993

[54] MILL ACTUATOR REFERENCE ADAPTATION FOR SPEED CHANGES

[75] Inventor: Ralf Starke, Louisville, Tenn.

[73] Assignee: Aluminum Company of America, Pittsburgh, Pa.

[21] Appl. No.: 869,476

[22] Filed: Apr. 15, 1992

[51] Int. Cl.[5] ..... B21B 37/00; G06G 7/66

[52] U.S. Cl. ..... 72/7; 72/11; 364/472

[58] Field of Search ..... 72/6-11, 72/19, 16, 17; 364/151, 157, 472

[56] References Cited

U.S. PATENT DOCUMENTS

| | | | |
|---|---|---|---|
| 3,158,049 | 11/1964 | Huntley | 72/8 |
| 3,574,280 | 4/1971 | Smith, Jr. | 364/472 |
| 3,618,348 | 11/1971 | Arimura et al. | 72/7 |
| 4,617,814 | 10/1986 | Kotera | 72/19 |
| 4,981,028 | 1/1991 | Berger et al. | 72/8 |

FOREIGN PATENT DOCUMENTS

| | | | |
|---|---|---|---|
| 0034211 | 2/1990 | Japan | 72/16 |
| 1632537 | 3/1991 | U.S.S.R. | 72/16 |

*Primary Examiner*—Lowell A. Larson

*Assistant Examiner*—Thomas C. Schoeffler

*Attorney, Agent, or Firm*—Elroy Strickland

[57] ABSTRACT

A method providing a rolling mill with compensation for changes occurring in rolling parameters that result from changes occurring in mill speed. The rolling parameters are under control of actuators that are connected to receive control reference voltages from electrical controllers. The method includes the step of generating a compensation function that describes the actuator movement required to maintain a rolling parameter at a desired level as a function of mill speed. This compensation function is used during mill speed changes to calculate a compensation value change for each actuator, a change that is required to maintain the parameter at the desired level. The compensation value change is added to a current level of the compensation value to provide a new, updated compensation value. The updated value is converted to a voltage for control of the actuator, and the voltage is added to the reference voltage of an associated electrical controller to provide a total voltage reference for the actuator. The total voltage reference is effective to substantially eliminate the occurrence of error in the controlling process caused by a change in mill speed.

2 Claims, 3 Drawing Sheets

MILL ACTUATOR REFERENCE ADAPTATION FOR SPEED CHANGES

BACKGROUND OF THE INVENTION

The present invention relates generally to the control of rolling mills and particularly to mill controls that compensate for changes occurring in rolling parameters that result from changes occurring in mill speed.

Changes in the rate of which a rolling mill reduces the thickness of a material directed through the mill, such as occurs when a mill is accelerated or decelerated, causes significant changes in the parameters of the rolling process, for reasons explained below. These parameters include the force at which mill rolls engage material in the roll bite of the mill, the friction in the roll bite, the torque at which the rolls direct the material through the roll bite, etc. Changes in such rolling parameters hamper the ability of the mill to produce consistent sheet thickness and flatness, which are quality concerns and thus the concern of the producer for his customers.

Generally, desired product quality is maintained by the use of reference values that are supplied to all mill actuators that control rolling parameters. These parameters include relative mill speed, average gap sizes, gap size differentials, average roll bending pressures, and differential roll bending pressures. The reference values, when properly set and adjusted, generally maintain desired product quality throughout small changes in mill speed.

Traditionally, closed loop, feedback control systems measure quality parameters, such as thickness and flatness downstream from the location of the roll gap where thickness and flatness disturbance are created. A required change in actuator setting is then calculated, and appropriate reference signals supplied to the respective actuators to correct thickness and flatness disturbances after the fact. Such adjustments are capable only of reducing, but not eliminating, parameter disturbances because of the delay in making corrections. The delay problem can be solved by using open loop, feedforward techniques, but these depend upon very accurate on-line mill models. Such models are expensive and require significant computational power. Further, mill conditions are not easily predicted and vary slowly over time. These aspects of rolling have not to date been accurately modeled yet they are associated with significant variations in critical rolling parameters as a result of mill speed changes. As a compromise, the rate of mill acceleration or deceleration is reduced on most mills today, as a slow pace in bringing the mill up to speed or slowing the mill down reduces the rate of parameter changes due to mill speed changes and, hence, allows the feedback controllers to more effectively reduce variations in critical rolling parameters.

SUMMARY OF THE INVENTION

The invention is directed to a method of mill control in which compensation functions (also referred to as forcing functions) are generated from historical data, i.e., data collected by observing mill behavior while coils of metal are rolled in a mill. Each compensation function describes future movements of a mill actuator, as a function of the mill speed, to maintain rolling parameters at desired levels during changes in mill speed. The compensation function is employed during mill speed changes to calculate a required change in the movement of each actuator. During this process, the compensation values, or actuator forcing outputs, have current levels. The required actuator movement for a given rolling parameter at a given speed change is added to the current level of the compensation value to provide a new, updated current compensation value or forcing function value, which new value is converted to a voltage. This voltage is sent to an electrical controller that supplies the actuator with the reference value (voltage) such that a total voltage reference is now supplied to the actuator. This is provided in a open loop feedforward manner. This total voltage reference is effective to substantially eliminate the occurrence of error in the controlling process caused by a change in mill speed.

It is therefore an objective of the invention to combine the advantages of open loop, feedforward control, which has minimum or no phase lag, and a closed loop feedback control that provides the necessary accuracy but occurs after the fact of an error. The scheme is based upon observations that for a given mill schedule and a given mill condition, outputs from most of the mill control systems to respective actuators follow a distinct pattern throughout the occurrence of speed changes.

The invention, in addition, avoids the use of mill models because the currently available models provide only limited usefulness in this type of mill control.

BRIEF DESCRIPTION OF THE DRAWINGS

The objectives and advantages will be better understood from consideration of the following detailed description and the accompanying drawings in which.

DETAILED DESCRIPTION OF PREFERRED EMBODIMENTS

Figure 1:
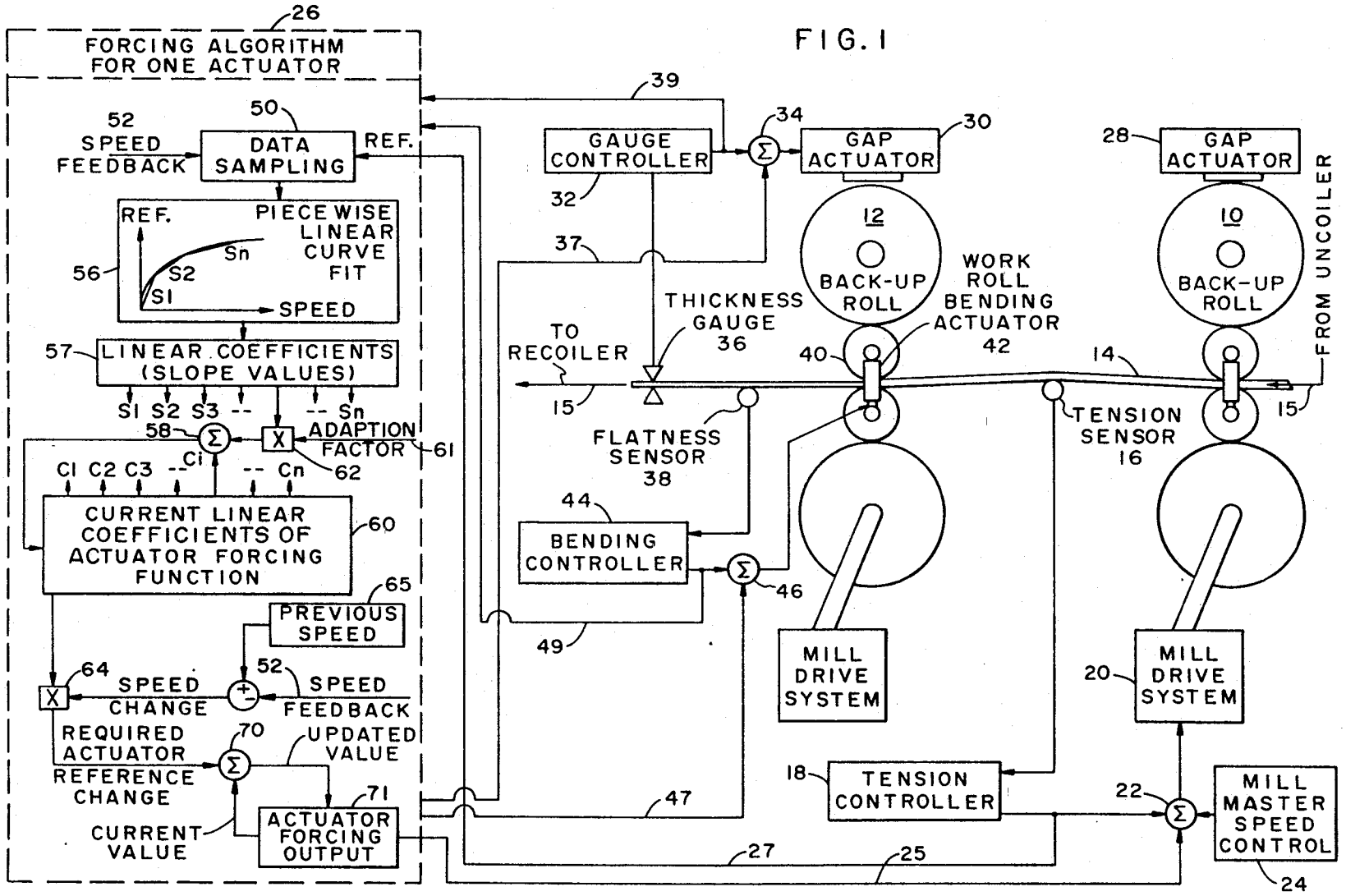
FIG. 1 is a schematic diagram showing an actuator forcing adaptation scheme for speed changes in a rolling mill, the scheme employing a controller output curve fitting technique to generate the above compensation, forcing function in a closed loop manner.

Referring now to FIG. 1 of the drawings, two stands 10 and 12 of a rolling mill are depicted diagrammatically in the process of reducing the thickness of a metal strip 14. (The direction of strip travel is indicated by two arrows 15. For purposes of clarity, a two stand mill is shown having three single loop single actuator control systems. The processes described hereinafter are, however, applicable to any number of stands, feedback controls and actuators.) Tension of the strip between the two stands is sensed by a sensor 16, which outputs a signal representing tension to an electrical controller 18; the controller, in response to the signal, adjusts tension by controlling the speed of stand 10, via its drive system 20, relative to the speed of stand 12. Before reaching the drive system, however, the controller output is combined at summing junction 22 with the output from a master speed control unit 24 and the output 25 from a forcing function algorithm 26 of the invention. The algorithm is described in detail hereinafter. The master speed control unit determines what the nominal speed of the mill stand should be at any point in time based on desired run speed of the mill, mill acceleration/deceleration rates and the schedule of thickness reduction.

The terms "controller" and "electrical controller," as employed hereinafter, refer to the typical proportional plus integral (PI) controller wherein the output thereof is proportional to current error and the time integral of past error, the error being the difference between the controller reference or set point and controller feedback.

The output from tension controller 18 is also directed to algorithm 26, via line 27, the algorithm providing forcing functions for tension and other parameters to be controlled (again) in a manner described hereinafter.

Strip tension, as well as the thickness of the strip, is also affected by the size of the rolling gaps of stands 10 and 12, which gaps are controlled by actuators 28 and 30. The actuators are, in turn, under control of electrical controllers, only one of which is shown in FIG. 1 and labelled 32. Gauge controller 32 is provided with thickness feedback from a device 36 that measures the thickness or gauge of strip 14. Actuators 28 and 30 comprise four actuators (mechanical screws or hydraulic cylinders), as there is an actuator on each side of each stand that controls the size of the roll gap and thus the gauge of this strip (14) being rolled.

Again, the output of controller 32 is combined at 34 with the output of algorithm 26. The gap actuator control output from algorithm 26 is conveyed via line 37 to junction 34, while the output of the gauge controller is sent to the algorithm 26 via lead 39.

The tension of strip 14 entering stand 10 is controlled by the drive system of a payoff coil of the strip (not shown), while the tension of strip leaving stand 12 is controlled by the drive system of a take-up reel (not shown).

The "flatness" of strip 14 leaving stand 12 is measured by a sensor 38. Flatness concerns are manifested as center and/or edge buckle in a sheet of material, the buckle being the result of uneven rolling force distribution across sheet width that causes relative portions of the sheet material in a widthwise direction to move at slightly different rates in the process of being reduced in thickness. To control and eliminate the buckle phenomenon, the work rolls of a mill stand are bent by a bending actuator. In FIG. 1, stand 12 has upper and lower work rolls 40 that are bent by cylinder actuators 42, one at each end of the work rolls, though only one is visible in FIGS. 1 to 3. Actuators 42 are fed information from flatness sensor 38, via bending controllers 44 (only one of which is shown), and, again, by the algorithm 26 via line 47. The outputs of the controller and algorithm are summed at junction 46. Like that of the gauge controller 32, the output of flatness controller 44 is also sent to algorithm 26, via lead 49.

A coil of metal (not shown) is directed through and reduced in thickness by stands 10 and 12. The speed of the process accelerates from standstill (zero velocity) up to a generally constant running speed at which the metal of the coil is reduced in thickness. When the strip of the coil nears runout from its payoff location, the stands decelerate to zero velocity, as the metal exiting stand 12 is wound into a new coil of metal at a recoil or take-up location (not shown).

During the accelerating and decelerating process and during other significant changes in mill speed, critical rolling parameters are adversely affected, as explained earlier, thereby affecting the quality of the material rolled during such acceleration and deceleration. When a second coil of metal is directed through the stands, the detrimental effects of acceleration and deceleration on the rolling parameters will not be as great because of the corrections "learned" by algorithm 26 of the invention from the first coil, as the actuators (20, 30, and 42) are forced to compensate for the detrimental effects caused by the speed changes. After several coils have been run, the algorithm will have reached substantially a steady state condition so that the mill controllers will no longer have to correct errors that occur as a result of mill speed changes, as explained below.

In the present invention, when a coil of metal is rolled by stands 10 and 12, algorithm 26 begins sampling at 50 the voltage outputs of all controllers (18, 32, and 44) via lines 27, 39, and 49 respectively, and the speed of strip travel at 52. The speed of travel can be sensed by a tachometer (not shown) that measures the speed of the work rolls (40) of stand 12. The data is sampled at 50 within given speed change segments. At the end of each segment, as shown in box 56 in FIG. 1, the algorithm applies a linear curve fit to the sampled data of controller output versus mill speed. The curve fit calculates linear coefficients or curve slopes Sl through Sn, generally designated by the next box 57, for the respective speed segments. A fraction of each coefficient is newly calculated and added at 58 to the respective values of the current coefficients, designated as Cl through Cn, in an updating process represented in FIG. 1 by box 60. An adaption gain factor 61 that is less than one (i.e., a fraction) is multiplied at 62 with each newly calculated coefficient to provide the calculated change in the compensation curve coefficient for the respective segment of speed change. The use of only a fraction of the new coefficient provides filtering of the data received from the controllers to eliminate controller output changes unrelated to speed changes. A compensation function coefficient might contain data relating to material hardness and alloy changes, for example.

The updated coefficients at 60 are next used to calculate at 64 the change in actuator references (box 71) required to adjust the respective actuators to control the rolling parameters in a manner that will compensate for changes in the parameters caused by speed changes of strip 14. Each change in strip speed is the difference between the strip speed during the previous execution of algorithm 26 (see box 65) and current strip speed at 52. The calculation at 64 multiplies the speed change by the respective linear coefficient for a given speed change segment to obtain the required change in the actuator reference 71. This reference change is added to the current value of the actuator reference 71 via summing junction 70. The current value of the actuator reference is then replaced with the updated value.

The updated actuator reference value is converted into a voltage at 71 and is conveyed via line 25, in the case of the strip tension parameter, to be summed at 22 with the output of tension controller 18 to provide a total voltage reference for mill drive 20. With the total and "correct" reference provided at 22, strip tension is adjusted with the changes occurring in the travel velocity of the strip. In the acceleration mode, this is a continuous, moving adjustment until the strip reaches a constant running speed.

The gauge and flatness control actuators 30 and 42 receive corrected reference voltages in the same manner as the tension control actuator (drive 20), i.e., algorithm 26 outputs actuator forcing references to the actuators over lines 37 and 47 via summing junctions 34 and 46.

The processes described thus far take place during the accelerating and decelerating portion of a coil run through stands 10 and 12. Before running the first coil, the algorithm of 26 has no knowledge (i.e., the forcing function coefficients are equal to zero) about what actions are necessary to compensate for the effects of speed changes on rolling parameters. The processes of the algorithm are repeated when the next coil is run, the next coil providing another set of forcing function coefficients needed to calculate required actuator reference changes for speed changes. A fraction of the new forcing function coefficient changes are then added to the current forcing function coefficients to provide new updated forcing functions. Each following coil run initiates the same process, making the system fully knowledgeable after several coils so that subsequent coils will be rolled "correctly" without parameter "error" due to speed changes. As mill process conditions change, the compensation function provided by algorithm 26 changes to reflect the process changes.

Figure 2:
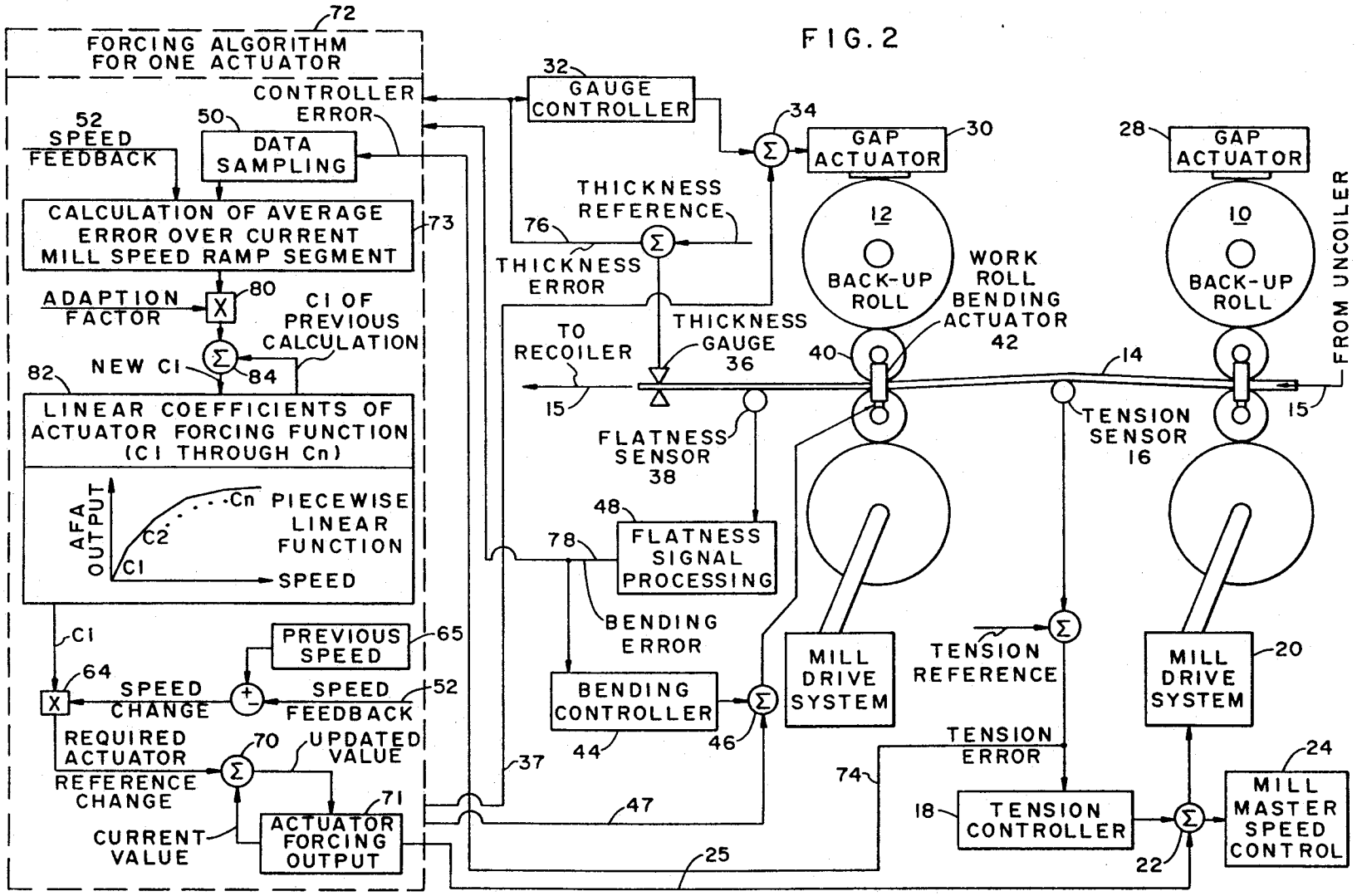
FIG. 2 is a schematic diagram of the forcing scheme of FIG. 1 except that an error integration technique is employed in place of the curve fitting procedure to generate the compensation function in a closed loop manner.

Referring to FIG. 2 of the drawings, a second, "error integration" embodiment of the invention is shown. More particularly, when stands 10 and 12 change speed, the processes of an algorithm 72 sample at 50 control errors, as a deviation of an actual feedback value from a target or reference value. In FIG. 2, error values are labelled 74, 76, and 78 for tension, gauge, and flatness parameters, respectively.

In FIG. 2, the components that are common with those of FIG. 1 bear the same reference numerals.

In regard to the flatness parameter of FIG. 2, the output of sensor 38 is "processed" at 48 in a manner that produces a bending error signal 78 when strip 14 is less than flat, i.e., the signal processing provides its own "reference" which is a flat strip. The error signal 78 will be used to correct the movement of bending actuator 42 as a function of speed after being processed by algorithm 72 to develop bending coefficients in the manner discussed below.

The average (integrated) error for each parameter is calculated at 73 over a strip speed range segment supplied through 52, during mill acceleration, deceleration and other significant changes in strip velocity. At the end of each segment, the average error is multiplied by an adaption gain factor at 80, which factor is a fraction. The product of 80 provides data for calculating coefficients Cl through Cn for piecewise linear actuator forcing functions, as shown in box 82, as a function of strip speed. The linear coefficient for the respective segment of the function depicted at 82 is added to the product at a summing junction 84. As a result, if any controller error is positive, for example, after being averaged at 73, the coefficient for the speed segment will be increased, and the output of function 82 will be larger for the next coil of metal rolled by the stands to reduce the error of the controller.

The adaption factor multiplied at 80 establishes the rate of change of the coefficients calculated at junction 84.

To calculate the required actuator movement, the coefficient concurrent with the present nominal speed of the strip is now multiplied at 64 in the algorithm with the speed change of strip 14, the change being (again) the difference between the speed of the strip during the previous execution of the algorithm and the current speed (52). The product of 64 is the change in actuator reference that is necessary for each actuator to compensate for the speed change effect on its associated rolling parameter.

Again at 70, in FIG. 2, the required actuator reference change is added to the current value of actuator reference 71 to provide an updated value of the actuator forcing reference.

As with the algorithm of 26, algorithm 72 "learns" during the rolling process so that after several coils of metal are rolled, the output from 72 assumes a uniform pattern as a function of speed, the pattern changing only as mill conditions change.

Figure 3:
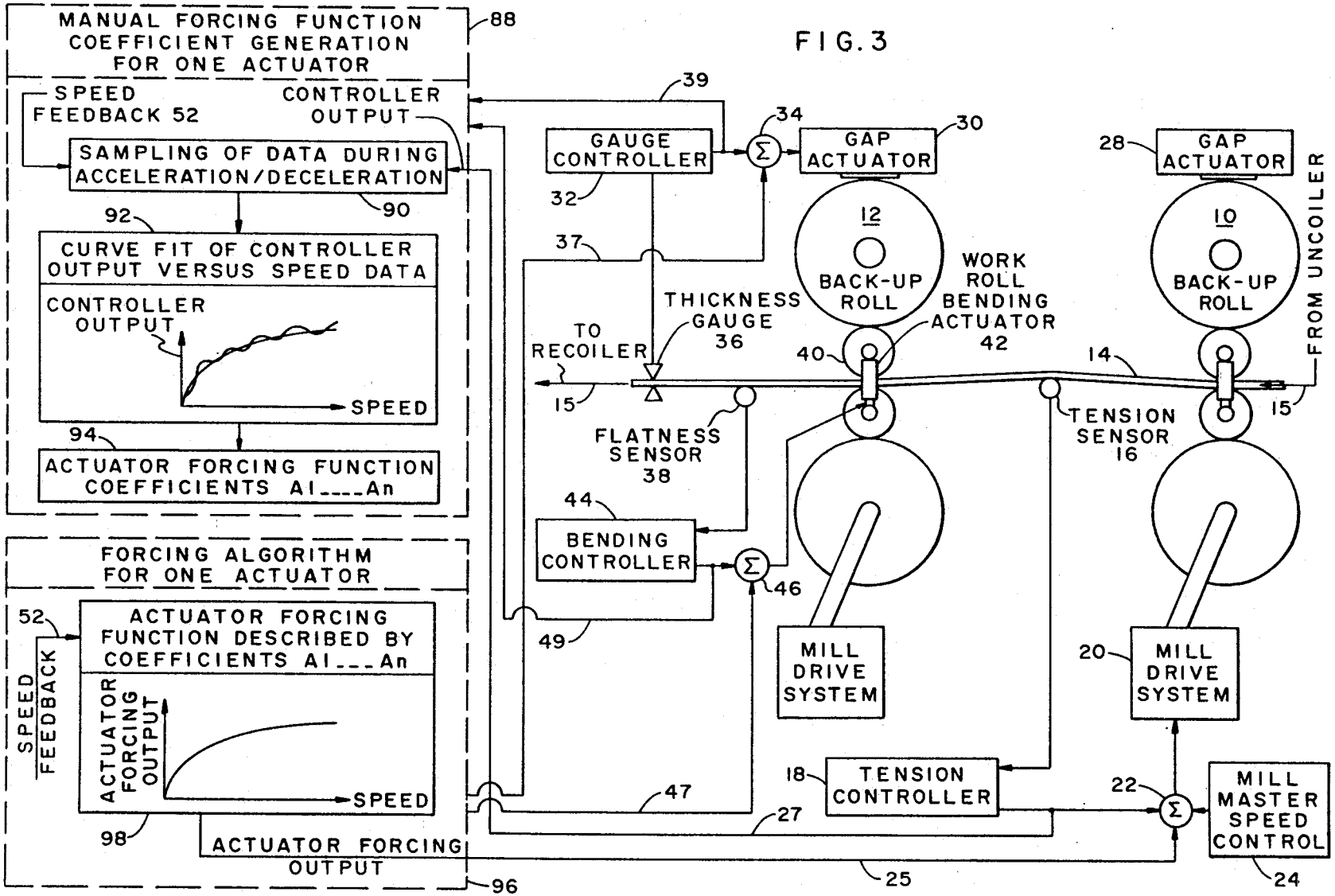
FIG. 3 is a schematic diagram of the subject forcing scheme except that the compensation function is generated manually in an open loop fashion.

FIG. 3 of the drawings shows a third method for providing actuator forcing functions. This method is similar to the method of FIG. 1 except that the forcing function is calculated manually in an open loop fashion. The forcing function generation is encompassed by block 88 and is performed by sampling speed and controller output values during mill acceleration or deceleration (box 90). A curve fit is applied to the sampled data at 92 to arrive at coefficients Al through An (94) describing the relationship between controller output and mill speed. This curve fitting function does not have to be piecewise and linear, as described for the methods of FIGS. 1 and 2 but can be continuous. The coefficients Al through An are then loaded into the mill control computer to be used in performing actuator forcing as a function of speed (box 96). During acceleration or deceleration of the mill, the algorithm uses mill speed input 52 and the forcing function coefficients to continuously calculate the required actuator forcing output (box 98).

Coefficients Al through An need to be determined separately for different product (strip 14) specifications. Also, this method does not adapt to changing mill conditions, which may require recalculation of the forcing function coefficients in case of major rolling process changes.

While the invention has been described in terms of preferred embodiments, the claims appended hereto are intended to encompass all embodiments which fall within the spirit of the invention.

What is claimed is:

1. A method of providing a rolling mill with compensation functions for changes occurring in rolling parameters that result from changes occurring in mill speed, said mill having a control system that automatically maintains the compensation functions updated regardless of changing conditions occurring in the mill, the compensation functions describing required movements for actuators connected to receive control voltages from the outputs of electrical controllers of said control system, the method comprising:

generating compensation functions that describe actuator movements as a function of the mill speed required to maintain rolling parameters at desired levels by sampling controller output voltages during changes in mill speed and developing therefrom a piecewise linear curve fit of controller output versus mill speed, the piecewise linear curve fit being described by linear coefficients or slope values of linear curves representing speed change segments;

multiplying said coefficients by an adaption gain factor to provide a fraction of each coefficient;

adding said fraction of each coefficient to the coefficient that is current to provide updated coefficients that reflect current mill conditions; and using said updated coefficients in conjunction with a change in mill speed to calculate the actuator movements required to maintain the rolling parameters at desired levels.

2. A method of providing a compensation function for at least one control system of a rolling mill, and for automatically maintaining the compensation function updated regardless of changing conditions in the mill said mill including at least one actuator under the control of an electrical controller for controlling at least one rolling parameter, the method comprising:

sampling controller output error values during changes in mill speed, said error values being the differences occurring between a reference value that is set for the controller and a feedback signal representing the rolling parameter;

averaging the sampled error over predetermined speed change intervals to provide an average of controller error values during an occurrence of mill speed changes;

multiplying said error values by an adaption gain factor to provide fractions of the averaged error values;

adding said fractions to current values of linear coefficients of required actuator movement versus speed function to provide updated coefficients reflecting conditions that are current in the mill, said actuator movement versus speed function being a piecewise linear curve described by said linear coefficients; and using said updated coefficients in conjunction with a mill speed change value for the calculation of the actuator movement required to maintain the rolling parameters at desired levels.

* * * * *